United States Patent [19]

Taylor

[11] Patent Number: 4,723,963

[45] Date of Patent: Feb. 9, 1988

[54] FUEL HAVING IMPROVED CETANE

[75] Inventor: William F. Taylor, Mountainside, N.J.

[73] Assignee: Exxon Research and Engineering Company, Florham Park, N.J.

[21] Appl. No.: 887,838

[22] Filed: Jul. 21, 1986

Related U.S. Application Data

[63] Continuation of Ser. No. 683,158, Dec. 18, 1984, abandoned.

[51] Int. Cl.[4] ..... C10L 1/18

[52] U.S. Cl. ..... 44/57; 44/77; 44/78; 585/14; 208/3

[58] Field of Search ..... 585/14; 44/57, 77, 78; 208/3

[56] References Cited

U.S. PATENT DOCUMENTS

| | | | |
|---|---|---|---|
| 1,363,870 | 12/1920 | Hayes | 44/56 |
| 1,388,531 | 8/1921 | Stevens | 44/56 |
| 1,516,907 | 11/1924 | Backhaus | 44/56 |
| 2,046,243 | 6/1936 | Buc | 44/56 |
| 2,350,145 | 5/1944 | Backoff et al. | 44/56 |
| 2,384,866 | 9/1945 | Wiczer | 44/56 |
| 2,874,033 | 2/1959 | Serniuk et al. | 44/56 |
| 2,897,067 | 7/1959 | Sparks et al. | 44/56 |
| 3,168,385 | 2/1965 | Giammeria et al. | 44/56 |
| 3,224,848 | 12/1965 | Henderson | 44/56 |
| 3,560,173 | 2/1971 | Coffey et al. | 44/56 |
| 3,832,149 | 8/1974 | Kozlowski et al. | 44/56 |
| 3,925,031 | 12/1975 | Villacanpa | 44/56 |
| 4,108,784 | 8/1978 | Bryant | 44/63 |
| 4,205,960 | 6/1980 | Bryant | 44/68 |
| 4,207,078 | 6/1980 | Sweeney et al. | 44/56 |
| 4,285,824 | 8/1981 | Bryant | 44/68 |
| 4,343,740 | 8/1982 | Bryant | 44/68 |

FOREIGN PATENT DOCUMENTS

| | | |
|---|---|---|
| 0014992 | 9/1980 | European Pat. Off. . |

*Primary Examiner*—William R. Dixon, Jr.
*Assistant Examiner*—Ellen McAvoy
*Attorney, Agent, or Firm*—Edward M. Corcoran; John W. Ditsler

[57] ABSTRACT

A middle distillate hydrocarbon fuel boiling in the range of about 160° C. to about 400° C. having an improved cetane number is disclosed. The fuel comprises at least about 3 weight percent oxygenated compounds preferably at least about 3 weight percent oxygenated aromatic compounds. The oxygenated compounds preferably comprise alkylaromatics and/or hydroaromatics, preferably oxygenated at the benzylic carbon position.

24 Claims, No Drawings

FUEL HAVING IMPROVED CETANE

This is a continuation of application Ser. No. 683,158, filed Dec. 18, 1984, abandoned.

BACKGROUND OF THE INVENTION

The present invention is related to a method for improving a middle distillate fuel. More specifically, the present invention is related to a method for improving the cetane number of a middle distillate diesel fuel boiling the range of about 160° C. to about 400° C.

The cetane number of a middle distillate diesel fuel is a measure of the ignition quality of the fuel. Fuels having a low cetane number frequently may be characterized by poor cold weather starting, long ignition delays, increased combustion noise and even misfiring.

Methods of improving the cetane number of fuels have taken on increasing importance as the refinery product slate has changed and as the quality of the crude feedstocks has declined. The heavier crudes currently being processed normally produce less virgin middle distillate, and the distillate which is produced tends to be of a lower quality. Moreover, the decline in residual fuel oil consumption often requires that at least a portion of the bottoms produced be upgraded by cracking. This upgraded middle distillate frequently is high in aromatic content, resulting in a low cetane rating. In addition, the rate of consumption of gasoline in many industrial countries has been relatively flat in recent years, while the consumption of diesel fuel and jet fuel has been increasing. To increase jet fuel production, frequently kerosene rich cuts are blended with the jet fuel. Addition of kerosene rich cuts, which have high cetane blending numbers, to the jet fuel necessarily decreases the quantity of kerosene available for use in diesel fuels. These factors have combined to make it increasingly important to maximize the quantity of middle distillate produced and to improve the cetane rating of the middle distillate fuels.

The oxygen content of crudes and of distillate fractions has been reported recently. Typically the oxygenated hydrocarbon content of middle distillate fuels is relatively low, i.e., about 1 weight percent of the fuel.

*Fundamental Aspects of Petroleum Geochemistry*, Elsevier Publishing Company, New York (1967) reports at page 110 that the oxygen content of crude oil normally is less than 3%, with most of this being fatty acids, naphthenic acids, and naphthenic-aromatic acids. Phenol normally is reported to be present below 0.1 percent, while ketones are present only in trace amounts. At page 151 it is reported that the phenol content of the light oil fraction increases because of cracking.

In a paper entitled "The Nitrogen and Oxygen Compounds in Petroleum" by L. R. Snyder, presented to the American Chemical Society in 1970, the author discloses the types of oxygen compounds present in various distillate fractions. In another paper by L. R. Snyder entitled "Petroleum Nitrogen Compounds and Oxygen Compounds" published in Accounts Chemical Research, Volume 3, 1970, the author presents an analysis of the nitrogen and oxygen contents of several distillates. In these papers the most predominant oxygenated compounds generally are the carboxylic acids. Since these compounds are corrosive, they usually are removed from the distillate, as, for example, by extraction with an alkali. Similarly, phenols are not desired in middle distillates for similar reasons. These compounds also are removed by caustic wash.

Since the oxygenated hydrocarbon content of distillates, excluding carboxylic acids and phenols, is rather low, the oxygenated hydrocarbon content of the middle distillate fuels has been relatively low, i.e., about 1 weight percent of the fuel.

In the past, several approaches have been taken to improve the cetane rating of the middle distillate fuels. One method has involved blending middle distillates having low cetane numbers with other feedstocks having a higher cetane rating. Another method has involved hydrotreating the middle distillate to thereby improve the cetane rating. A third method has involved adding cetane improvers, such as alkyl nitrates, to the distillate to raise the cetane numbers. However, these methods for increasing the cetane number of the fuels have several disadvantages. Blending the middle distillate pool with one or more product streams, such as virgin kerosene fractions, having a higher cetane rating may not be the most profitable disposition of these product streams.

Hydrotreating increasing amounts of middle distillate fuels may not be either desirable or possible at many refineries. Hydrotreating throughput limitations and available sources of hydrogen may limit the amount of middle distillates which economically can be upgraded in this manner. In addition, the cost of operating the hydrotreating facilities may be significant.

Similarly, the use of large amounts of cetane improvers, such as alkyl nitrates, is not desirable, since these additives may be relatively expensive and require balancing cetane improvement against possible loss of desirable fuel stability properties.

Considerable work has been directed in the past at improving the cetane number of middle distillate fuels. U.S. Pat. No. 2,521,698 is directed at the partial oxidation of hydrocarbon fuels to improve their cetane ratings. This patent discloses that the fuel should have a relatively low aromatic ring content and a high paraffinic content.

U.S. Pat. No. 2,912,313 discloses that the addition of both a peroxide and a dihalo compound produces a synergistic increase in the cetane number.

European patent application No. 14,992 discloses that aliphatic polyethers may be used as components of diesel fuel because of their high cetane numbers.

German Pat. No. 3,136,030 discloses that the cetane number of dialkoxyalkanes can be increased by partial oxidation with ozone or hydrogen peroxide.

These methods of increasing the cetane numbers of fuels have not proven completely satisfactory. Oxidation of paraffinic-rich fuel streams may not be desirable, since these streams typically have relatively high initial cetane numbers, and since oxidation has been found to degrade the cetane quality. The use of additives to increase the cetane rating of the fuel may not always be desirable because of the cost of the additives and their adverse effect on fuel storage stability.

Accordingly, it would be desirable to provide a process for improving the cetane number of middle distillate fuels which does not require the use of costly additives or the use of hydrogen. It also would be desirable to provide a process for improving the cetane rating of a middle distillate which does not require the addition of higher quality petroleum streams which have more profitable end uses.

It also would be desirable to provide a reliable process for upgrading the cetane number of middle distillate fuels which requires a relatively low capital investment and relatively little operator attention.

The present invention is directed at a method for improving the cetane number of a middle distillate fuel by selectively converting hydroaromatic and certain aromatic compounds to oxygenated compounds, such as alcohols, ketones, ethers and aldehydes. In one preferred embodiment an aromatic and hydroaromatic rich stream, such as a light cat cycle oil, a light cat heating oil, or a coker liquids stream is selectively oxygenated. The resulting oxygenated stream may be used as a diesel fuel alone, or it may be blended with other petroleum streams to produce a middle distillate stream having an acceptable cetane rating.

In another preferred embodiment, the middle distillate fuel is separated into a first fraction relatively rich in aromatic and hydroaromatic compounds, and into a second fraction relatively rich in paraffinic and cycloparaffinic compounds. The first fraction subsequently is oxygenated. This oxygenated first fraction may be used alone or may be blended with other petroleum streams, such as the second fraction, to produce a middle distillate having an improved cetane number. In still another preferred embodiment, hydroaromatic and aromatic compounds selectively are converted into the corresponding oxygenated compounds in situ.

SUMMARY OF THE INVENTION

The present invention comprises a middle distillate hydrocarbon fuel boiling in the range between about 160° C. and about 400° C., having an improved cetane number comprising at least 3 weight percent, preferably at least about 5 weight percent, and more preferably at least about 10 weight percent oxygenated compounds, excluding the phenolic and carboxylic acid compounds which normally are almost completely removed.

The present invention also is directed at a middle distillate hydrocarbon fuel boiling in the range of about 160° C. to about 400° C., comprising at least about 3 weight percent oxygenated aromatic compounds, preferably at least 5 weight percent oxygenated aromatic compounds and more preferably at least about 10 weight percent oxygenated aromatic compounds.

The present invention also comprises a middle distillate fuel boiling in the range of about 160° C. and 400° C. comprising between about 0.5 and about 75 weight percent alkylaromatics and/or hydroaromatics, preferably between about 2 and about 50 weight percent alkylaromatics and/or hydroaromatics, and more preferably between about 5 and about 30 weight percent alkylaromatics and/or hydroaromatics.

The present invention also comprises a middle distillate fuel boiling in the range of about 160° C. and about 400° C. comprising at least about 0.5 weight percent, preferably at least about 1 weight percent, alkylaromatic oxygenated compounds. The fuel may comprise up to about 75 weight percent alkylaromatic oxygenated compounds.

The present invention also comprises a middle distillate fuel boiling in the range between about 160° C. and 400° C. comprising at least about 0.5 weight percent alkylaromatic and/or hydroaromatic compounds oxygenated at the benzylic carbon position, preferably at least about 2 weight percent alkylaromatics and/or hydroaromatics oxygenated at the benzylic carbon position and more preferably at least 5 weight percent alkylaromatics oxygenated at the benzylic carbon position. The fuel preferably comprises between about 0.5 and about 75 weight percent alkylaromatics and/or hydroaromatics oxygenated at the benzylic carbon position.

The present invention further is directed at a middle distillate fuel boiling in the range between about 160° C. and about 400° C. comprising at least about 0.5 weight percent, preferably at least about 1 weight percent of aromatic oxygenated compounds selected from the group consisting of alcohols, ketones, ethers and aldehydes and mixtures thereof. The fuel may comprise up to about 75 weight percent of these aromatic oxygenated compounds.

The present invention also is directed at a middle distillate hydrocarbon fuel boiling between about 160° C. and about 400° C., having an improved cetane number comprising an oxygenated fraction selected from the group consisting of oxygenated light cat cycle oil, oxygenated light cat heating oil, oxygenated coker liquid and mixtures thereof. The oxygenated fraction preferably comprises at least 3 weight percent of the total hydrocarbon fuel.

DETAILED DESCRIPTION OF THE INVENTION

The present invention is directed at the selective oxidation of aromatic compounds present in a middle distillate hydrocarbon fuel to improve the cetane rating of the fuel. Therefore, as used herein the term "hydrocarbon fuel" is defined to be a fuel including carbon-hydrogen compounds which have been oxygenated. It has been found that the selective oxidation of aromatics present in the fuel, particularly alkylaromatics and hydroaromatics, at the benzylic position, improves the cetane rating of the fuel. However, it also has been found that oxidation of the paraffins and cycloparaffins present in the fuel or oxidation of aromatics at non-benzylic positions, such as in the ring, to form a phenol, adversely affects the cetane rating of the fuel.

The effect on cetane quality of molecular changes in compounds present in middle distillate fuel and their corresponding oxygenated compounds was determined by measuring their cetane blending numbers in a number of diesel fuels covering a range of compositions and cetane numbers. The measurement of cetane blending numbers, although more difficult to accomplish than simply measuring a cetane number, is important, since the subject compounds are used in blends and diesel fuels rather than as individual pure compounds. The effect of blending different compounds on the cetane number cannot be predicted based on the cetane number of the individual compounds, since currently there are no relatively accurate cetane blending-correlations. Moreover, the measurement of the cetane blending number was necessary, since compounds having a cetane number below about 20 cannot be measured in a cetane engine.

To minimize data scatter and the effect of random variables, a series of six measurements was conducted on each additive tested to determine the average cetane blending number. Base pools were prepared from refinery diesel blending stocks and blended to provide a range of cetane levels, i.e., a low cetane fuel (approximately 38 cetane number), a medium cetane fuel (approximately 41 cetane number) and a high cetane fuel (approximately 49 cetane number). The cetane numbers of each diesel pool were measured each time immediately prior to measuring the cetane number of the pure compound in the diesel pool. The cetane blending number of various pure compounds generally was determined at the 20 weight percent level in three different diesel pools and the results arithmatically averaged. A weight concentration rather than a volume concentration was used in preparing the blends because many pure compounds which were tested are solids at room temperature.

The cetane blending numbers were calculated according to the following linear blending equation:

$$CBN = \frac{CN_{Blend} - (1 - X)CN_{Base}}{X}$$

where:

X=fraction of compound added to base pool to form blend;

CN=cetane number of the base or the blend, both measured in the cetane engine, with the blend being measured immediately after the base; and CBN=calculated cetane blending number.

The effect of adding an alcohol, ketone, ester and ether functionality to a paraffin, cycloparaffin, aromatic and hydroaromatic is shown in Tables I and II. In these tables, the average cetane blending numbers of the three pools are shown. The average cetane blending number of the pure compound is shown, with the change in average cetane number calculated preceded by a plus (+) for an increase in cetane number and preceded by a minus (−) for a decrease in cetane number. As shown in Table I, adding an oxygenate functionality to a hydroaromatic and to alkyl aromatics, in the benzylic position improved the cetane blending number. By contrast, as shown in Table II, adding an oxygenate functionality to a paraffin or cycloparaffin reduced the cetane blending number. As shown in Tables III and V, adding an oxygenate functionality to an alkyl aromatic in a non-benzylic side chain position or directly to the ring to form the phenol, reduced the cetane blending number.

The structure oxygenated and the location of the oxygenated functionality also affects the cetane number of normal and branched paraffinic compounds. As shown in Table II, as an alcohol functionality is added to normal octane, the least loss of cetane quality occurs at the primary position and progressively greater loss of cetane quality occurs as the functionality is moved toward the center of the molecule. Similar effects also are shown in Table II for a branched paraffin, 2-ethyl hexane, where addition of the oxygenate functionality causes the least loss at the primary position as compared to an interior position.

TABLE I

Effect of Oxygenate Functionality on Cetane Blending Number Δ of Aromatics and Hydroaromatics

| Base Hydrocarbon Average Cetane Blending Number | Change in Average Cetane Blending Number: Alcohol | Ketone | Methyl Ether |
|---|---|---|---|
| • n-Propylbenzene 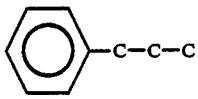 (6.2) | 1-Phenyl-1-propanol 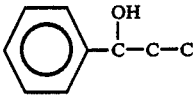 Δ = +4.5 | | |
| • i-Propylbenzene 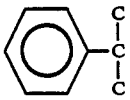 (9.4) | 2-Phenyl-2-propanol 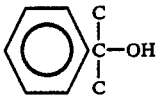 Δ = +3.6 | | |
| • Biphenyl 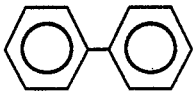 (17.0) | 2-phenyl phenol 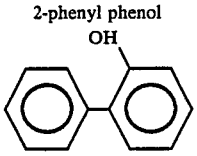 Δ = −22.6 | | O—Methoxybiphenyl 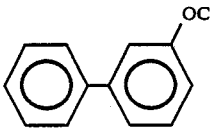 Δ = −2.9 |
| 1,2,3,4-Tetrahydro naphthalene (Tetralin) 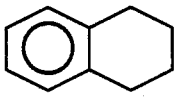 (2.2) | 1,2,3,4-Tetrahydro 1-naphthol 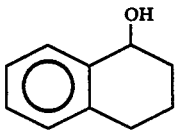 Δ = +12.8 | α-Tetralone 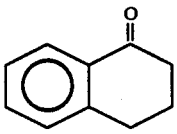 Δ = +15.1 | 6-Methoxy-1,2,3,4-tetrahydro naphthalene 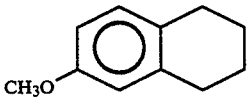 Δ = +3.7 |
| • Fluorene | | 9-Fluororenone | |

TABLE I-continued
| Base Hydrocarbon Average Cetane Blending Number | Effect of Oxygenate Functionality on Cetane Blending Number Δ of Aromatics and Hydroaromatics | | |
|---|---|---|---|
| | Change in Average Cetane Blending Number | | |
| | Alcohol | Ketone | Methyl Ether |
| 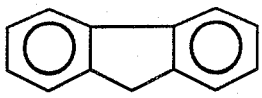 (6.0) | | 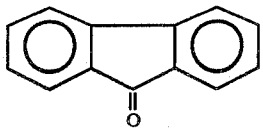 Δ = +14.1 | |

TABLE II

Effect of Oxygenate Functionality on Cetane Blending Number of Paraffins and Cycloparaffins

| Base Hydrocarbon Average Cetane Blending Number | Change in Average Cetane Blending Number: Alcohol | Ketone | Ester | Ether |
|---|---|---|---|---|
| • n-Octane<br>C—C—C—C—C—C—C—C<br>(57.5) | 1-octanol<br>OH<br>C—C—C—C—C—C—C—C<br>Δ = −16.7 | | | |
| | 2-Octanol<br>OH<br>C—C—C—C—C—C—C—C<br>Δ = −28.0 | 2-Octanone<br>O<br>C—C—C—C—C—C—C—C<br>Δ = −30.0 | Methyl octanoate<br>O<br>C—O—C—C—C—C—C—C—C—C<br>Δ = −23.6 | |
| | | | Octyl Formate<br>O<br>C—O—C—C—C—C—C—C—C—C<br>Δ = −17.0 | |
| | 3-octanol<br>OH<br>C—C—C—C—C—C—C—C<br>Δ = −32.7 | | | |
| | 4-octanol<br>OH<br>C—C—C—C—C—C—C—C<br>Δ = −38.2 | | | |
| • 2-Ethyl hexane<br>C<br>C<br>C—C—C—C—C—C<br>(35.9) | 2-Ethyl-1-hexanol<br>C<br>OH C<br>C—C—C—C—C—C<br>Δ = −7.1 | | | |
| | 4-Ethyl-3-hexanol<br>C<br>OH C<br>C—C—C—C—C—C<br>Δ = −22.6 | | | |
| • 2,2,4-Trimethyl pentane | 2,4,4-Trimethyl-1-pentanol | | | |

TABLE II-continued

Effect of Oxygenate Functionality on Cetane Blending Number of Paraffins and Cycloparaffins

| Base Hydrocarbon Average Cetane Blending Number | Change in Average Cetane Blending Number | | | |
|---|---|---|---|---|
| | Alcohol | Ketone | Ester | Ether |
| 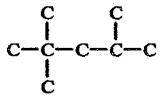 (10.8) | 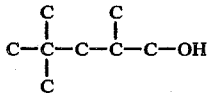 Δ = −10.4 | | | |
| • 1,4-Dimethylcyclohexane 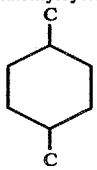 (45.1) | 2,6-Dimethylcyclohexanol 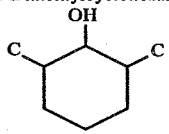 Δ = −31.2 | 2-6,Dimethylcyclohexanone 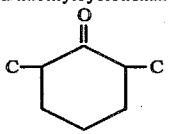 Δ = −35.0 | | |
| | 2,3-Dimethylcyclohexanol 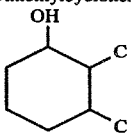 Δ = −26.8 | | | |
| • Decalin 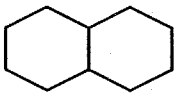 (38.3) | | 2-Decalone 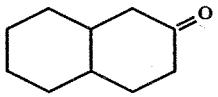 Δ = −11.4 | | |

Improvements in the cetane numbers of certain aromatics and hydroaromatics are dependent on the type and location of the functional group. The most effective compounds found for significantly increasing the cetane number are the hydroaromatics with the oxygenate functionality attached at a non-aromatic carbon, preferably to a benzylic carbon atom, i.e., a carbon adjacent to an aromatic ring. As shown in Table III for alkyl benzenes and in Table IV for alkyl naphthalenes the maximum cetane number usually is achieved when the oxygenate functionality is attached to a benzylic carbon position. By contrast, as shown in Table V, when the oxygenate functionality is attached directly to the aromatic ring, a decrease in cetane number normally results. This is particularly the case when a hydroxy group is attached to the ring to form a phenol.

TABLE III

Effect of Oxygenate Addition to Alkyl Benzenes

| Base Hydrocarbon (Ave. Cetane Blending Number) | Change in Average Cetane Blending Number: Benzylic | Change in Average Cetane Blending Number: Non-Benzylic |
|---|---|---|
| • Toluene 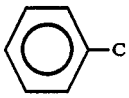 (8.3) | Benzyl Alcohol 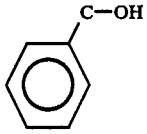 Δ = +5.6 | |
| • N—Propylbenzene 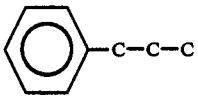 (6.2) | 1-Phenyl-1-Propanol 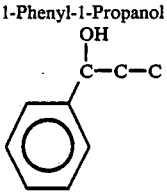 Δ = +4.5 | 1-Phenyl-2-Propanol 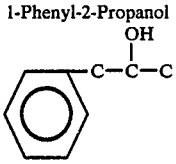 Δ = −5.0 |
| | | 3-Phenyl-1-Propanol 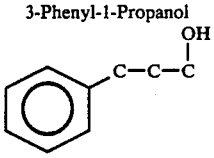 Δ = −6.1 |
| • I—Propylbenzene 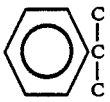 (9.4) | 2-Phenyl-2-Propanol 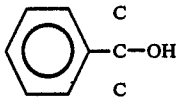 Δ = +3.6 | 2-Phenyl-1-Propanol 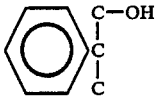 Δ = −7.8 |

TABLE IV

Effect of Oxygenate Addition to Alkyl Naphthalenes

| Base Hydrocarbon (Average Cetane Blending Number) | Change in Average Cetane Blending Number, Δ: Alcohol | Change in Average Cetane Blending Number, Δ: Ketone or Aldehyde |
|---|---|---|
| • 1-Methyl Naphthalene 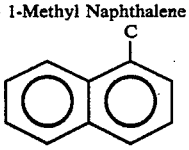 (12.6) | | 1-Naphthaldehyde 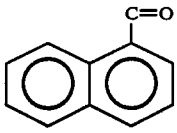 Δ = +1.5 |
| • 2-Ethyl Naphthalene 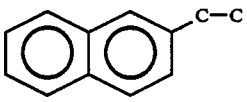 (5.0) | αMethyl-2-Naphthalene Methanol 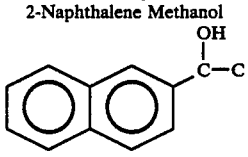 Δ = +17.6 | 2-Acetonaphthone 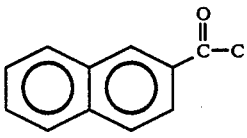 Δ = +7.8 |
| | | 1-Acetonaphthone |

TABLE IV-continued

| Effect of Oxygenate Addition to Alkyl Naphthalenes | | |
|---|---|---|
| Base Hydrocarbon (Average Cetane Blending Number) | Change in Average Cetane Blending Number, Δ | |
| | Alcohol | Ketone or Aldehyde |
| | | 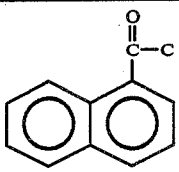 Δ = +7.5 |

TABLE V

| Effect of Methoxy and Hydroxy Addition Directly to Aromatic Rings | |
|---|---|
| Base Hydrocarbon (Average Cetane Blending Number) | Change in Average Cetane Blending Number of Oxygenated Compounds Relative to Hydrocarbon |
| • Toluene 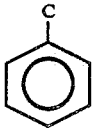 (8.3) | P—Methylanisole 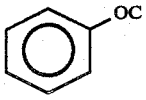 Δ = −12.0 |
| • Tetralin 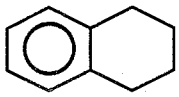 (2.2) | 6 Methoxy 1,2,3,4 Tetrahydro-naphthalene 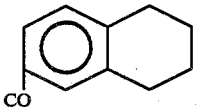 Δ = +3.7 |
| • Naphthalene 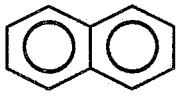 (21.9) | 1-Methoxynaphthalene 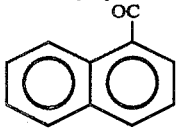 Δ = −12.2 |
| • Biphenyl 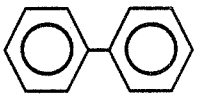 (17.0) | O—Methoxybiphenyl 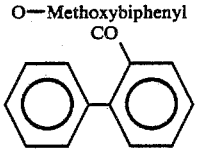 Δ = −2.9 |
| Toluene 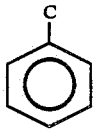 (8.3) | p-Cresol 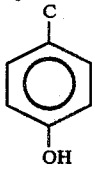 Δ = −45.6 |
| Indan 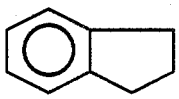 (6.0) | 5-Indanol 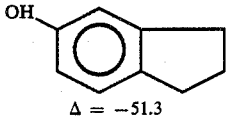 Δ = −51.3 |
| Tetralin | 5,6,7,8 Tetrahydro -2- |

TABLE V-continued

| Effect of Methoxy and Hydroxy Addition Directly to Aromatic Rings | |
|---|---|
| Base Hydrocarbon (Average Cetane Blending Number) | Change in Average Cetane Blending Number of Oxygenated Compounds Relative to Hydrocarbon |
| 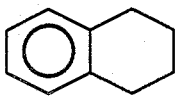 (2.2) | Naphthol 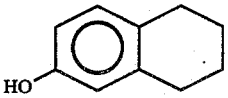 Δ = −39.9 |
| Biphenyl 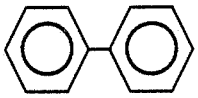 (17.0) | 2-Phenylphenol 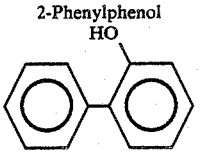 Δ = −22.6 |

When aromatic hydrocarbons are utilized, the maximum cetane number from oxygenation is achieved by converting polynuclear aromatics, such as naphthalenes, phenanthrenes and mixtures thereof, to the corresponding hydroaromatics. Although conversion of the multiple ring compounds to cycloparaffins would result in a still higher cetane number, the cost is high for the cetane improvement obtained. This is attributable to the greater hydrogen consumption, higher severity and higher pressure operation required to completely convert hydroaromatics to cycloparaffins. Therefore, when polynuclear aromatics are present, it can be seen that the present invention most economically can be practiced if the polynuclear aromatics are partially hydrogenated to hydroaromatics and oxygenated, rather than being completely hydrogenated to cycloparaffins prior to oxygenation. It can be seen that partial hydrogenation followed by oxygenation may produce a substantial increase in cetane at a lower cost per cetane number increase than complete hydrogenation of the polynuclear aromatic compounds to cycloparaffins.

From a review of the cetane number obtained from Tables I, III and IV, it can be seen that an improvement in cetane of a given hydroaromatic or aromatic compound is achieved by the addition at the benzylic position of either the carbonyl or hydroxy oxygenate functionality to form an alcohol, ketone or aldehyde. It also may be noted from Table I that an improvement in cetane was achieved by adding an ether at a non-benzylic position and that the addition of the ether to the aromatic ring produced better cetane blending numbers than the addition of the hydroxy functionality to the same compounds on the aromatic ring. This indicates that the addition of the ether functionality to the benzylic position could produce even better cetane blending numbers. Thus, the particular oxygenated functionality utilized may be determined, in part, based upon the cost to manufacture, freedom from other product quality problems, etc.

The present invention can be utilized to produce a middle distillate hydrocarbon fuel boiling in the range of about 160° C. to about 400° C., having an improved cetane number preferably comprising at least about 3 weight percent oxygenated compounds, more preferably at least 5 weight percent oxygenated compounds and most preferably at least about 10 weight percent oxygenated compounds. The oxygenated compounds preferably comprise aromatic oxygenated compounds, with the compounds preferably comprising alkylaromatics, oxygenated at the benzylic position to the alcohol, ketone, aldehyde or ether. The oxygenated aromatic compounds preferably comprise at least about 3 weight percent of the hydrocarbon fuel, more preferably at least about 5 weight percent of the fuel, and most preferably at least about 10 weight percent of the fuel. The hydrocarbon fuel preferably comprises at least about 0.5 weight percent of aromatic compounds oxygenated at the benzylic carbon position, more preferably at least about 2 weight percent aromatic compounds oxygenated at the benzylic carbon position, and most preferably at least about 5 weight percent aromatic compounds oxygenated at the benzylic carbon position. The alkyl aromatic compounds comprise at least about 0.5 weight percent, preferably at least 1 weight percent of the fuel. The fuel preferably may comprise up to about 75 weight percent alkyl aromatic compounds.

Since aromatic-rich refinery feedstreams have been found to have relatively low cetane numbers, and since oxygenated aromatic compounds exhibit a sharp improvement in cetane, one particularly attractive method for improving the cetane number is to oxygenate refinery streams which have relatively high aromatics contents, such as liquid cat cycle oils, liquid cat heating oils, coker liquids, and mixtures thereof. Middle distillate fuels usually comprise a blend of refinery streams, such as virgin distillates, which have relatively high cetane numbers, and aromatics-rich process streams, which typically have relatively low cetane values. By oxygenating at least a portion of the aromatics-rich stream, increased quantities of the aromatics-rich stream can be blended with the virgin distillate to produce a middle distillate fuel having the same cetane number. Alternatively, the relative quantities of the aromatics rich stream and virgin distillate can be maintained constant, and the aromatics-rich stream oxygenated, thereby increasing the cetane number of the middle distillate product.

Utilizing the present invention, a middle distillate could be produced having at least about 3 weight percent oxygenated aromatics preferably at least about 5 weight percent aromatics and more preferably at least about 10 weight percent aromatics. Since the greatest increase in cetane blending number is achieved by oxygenating hydroaromatics, a preferred middle distillate hydrocarbon fuel comprises at least 0.5 weight percent hydroaromatics, more preferably at least 1.0 weight percent, where at least a portion of the hydroaromatics are oxygenated at the benzylic position. The fuel may comprise up to about 75 weight percent oxygenated aromatics.

In some applications, it may be desirable to separate refining streams comprising aromatics and paraffinic compounds into an aromatic-rich stream for subsequent oxygenation, and a paraffinic-rich stream. One method for selectively oxygenating hydroaromatics and aromatic compounds while not oxygenating the paraffinic and cycloparaffinic compounds is to separate the feedstock into a first fraction relatively rich in hydroaromatic and/or aromatic compounds and a second fraction relatively rich in paraffinic and/or cycloparaffinic compounds. Among the preferred methods for separating the feedstock into the first and second fractions are distillation, extraction and adsorption on a solid adsorbent, with the preferred method being extraction. The hydroaromatic and aromatic compounds may be selectively oxygenated by passing oxygen and/or air through the compounds or by the use of chemical oxygen donor compounds. Alternatively, the hydroaromatic and aromatic compounds may be oxygenated by reaction first to form the corresponding halide followed by hydrolysis to form the alcohol. Similarly, alkyl aromatics may be oxygenated by dehydrogenating alkyl aromatics to olefinic aromatics and reacting the olefinic aromatics with water, or with carbon monoxide and hydrogen.

The oxygenated aromatics and/or hydroaromatics preferably are blended with a fraction relatively rich in paraffin and/or cycloparaffins, such as a virgin distillate, to produce a middle distillate fuel having improved cetane. Alternatively, the oxygenated first fraction could be used as a diesel fuel alone.

The particular streams which are to be oxygenated, the extent to which each aromatic stream should be oxygenated and/or the amount which should be blended with a paraffinic-rich stream will be dependent, in part, on the solubility, melting point and boiling point of the oxygenated aromatics. As shown in Table VI, oxygenating typical aromatics frequently increases the melting point, boiling point and decreases the solubility of the aromatic components. Thus, the boiling point, melting point and solubility effects will be significant factors in preparing oxygenated middle distillate fuels. The hydrocarbon fuel, preferably may comprise about 0.5 to about 75 weight percent alkylaromatics and/or hydroaromatics, more preferably about 2 to about 50 weight percent alkylaromatics and/or hydroaromatics and most preferably about 5 to about 30 weight percent alkylaromatics and/or hydroaromatics.

TABLE VI

BOILING POINT AND MELTING POINT CHANGES WITH SELECTIVE OXIDATION

| | Hydrocarbon | | | Oxygenate | | | Increase With Oxidation | |
|---|---|---|---|---|---|---|---|---|
| Carbon Number | Compound | Melting Point °C. | Boiling Point °C. | Compound | Melting Point °C. | Boiling Point °C. | Melting Point °C. | Boiling Point °C. |
| $C_8$ | Isopropylbenzene | −96 | 153 | 2-Phenyl-2-Propanol | 33 | 202 | 129 | 49 |
| $C_9$ | Indan | −51 | 176 | 1-Indanone | 41 | 244 | 92 | 68 |

TABLE VI-continued

BOILING POINT AND MELTING POINT CHANGES WITH SELECTIVE OXIDATION

| | Hydrocarbon | | | Oxygenate | | | Increase With Oxidation | |
|---|---|---|---|---|---|---|---|---|
| Carbon Number | Compound | Melting Point °C. | Boiling Point °C. | Compound | Melting Point °C. | Boiling Point °C. | Melting Point °C. | Boiling Point °C. |
| | | | | 1-Indanol | 52 | — | 103 | — |
| $C_{10}$ | Tetralin | −35 | 207 | α-Tetralone | 6 | — | 41 | — |
| $C_{11}$ | 1-Methylnaphthalene | −22 | 241 | 1-Naphthaldehyde | 2 | — | 24 | — |
| | | | | 1-Naphthalenemethanol | 61 | — | 83 | — |
| $C_{12}$ | 2-Ethylnaphthalene | −70 | 251 | 2-Acetonaphthone | 54 | 300 | 124 | 49 |
| | Acenaphthene | 92 | 279 | 1-Acenaphthenol | 147 | — | 55 | — |

In the data presented above it has been shown for individual aromatic and hydroaromatic compounds that selective oxygenation may improve the cetane rating of the fuel. A series of tests also were conducted on simulated aromatic-rich streams to demonstrate that the actual cetane blending number obtained when the aromatic fractions were replaced by their oxygenated analogs closely approximated the theoretical cetane blending number. These data are reported in Tables VII and VIII. The data for Blend I reflects complete conversion of the aromatic compounds to ketones and alcohols, while the data for Blend II reflects complete conversion of the aromatics to alcohol.

Methods which preferentially oxygenate aromatics and/or hydroaromatics without substantially oxygenating paraffins and cycloparaffinic compounds may obviate the need to separate the feed into a fraction relatively rich in aromatics and/or hydroaromatics and a fraction relatively rich in paraffins and/or cycloparaffins. This may be accomplished by a low temperature free radical autooxidation process using pure oxygen or air as the oxidizing agent. This process would selectively attack the weak benzylic C-H bonds of the alkylaromatics and hydroaromatics, resulting in the initial formation of a hydroperoxide. The hydroperoxide can be decomposed to the corresponding alcohol aldehyde,

TABLE VII

SIMULATED SELECTIVE OXIDATION OF AROMATIC RICH STREAM

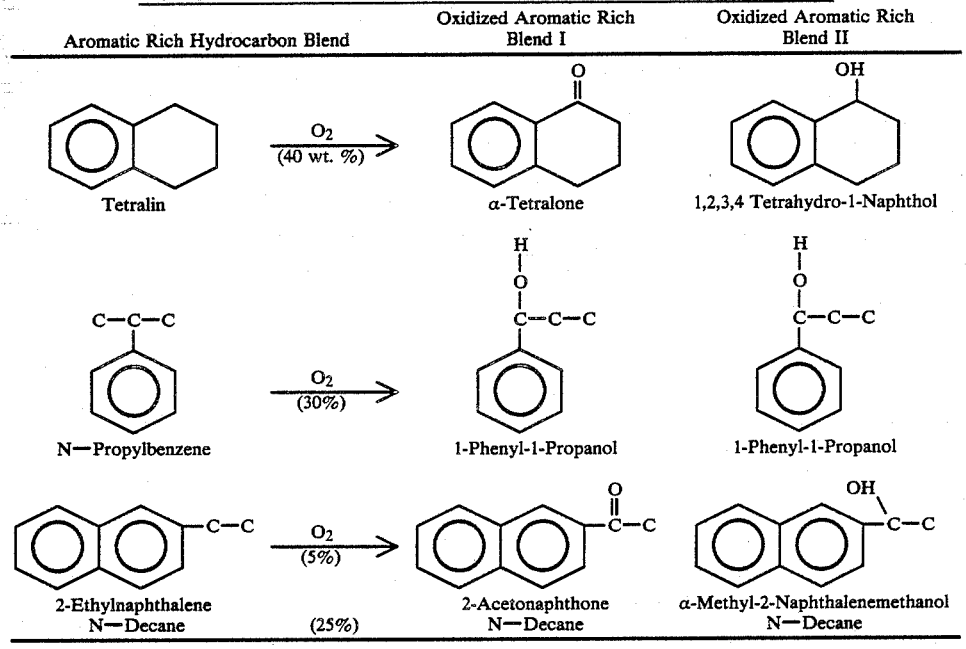

TABLE VIII

Summary of Blend Results

| Four Component Blend | Expected Cetane Blending Number | Measured Average Cetane Blending Number |
|---|---|---|
| Aromatic Rich Hydrocarbon | 24 | 21.6 |
| Oxidized Aromatic Rich Blend I (Ketone/Alcohol) | 30 | 27.6 |
| Oxidized Aromatic Rich Blend II (All Alcohol) | 30 | 33.4 |

ketone or mixtures thereof, either thermally or catalytically giving the desired oxygenated product. The temperature must be kept low enough to avoid attack on the much stronger bonds of the primary, secondary and tertiary alkyl carbon-hydrogen bonds of the paraffins and cycloparaffins and the much stronger carbon-hydrogen bonds of the aromatic rings which would reduce the cetane number of the fuel. Thus, this selective oxidation process may improve the cetane rating in two ways:

1. By oxygenating aromatic compounds; and
2. By the in-situ formation of hydroperoxides which operate as cetane improvers. The hydroperoxide concentration preferably should be maintained below about 1 weight percent, preferably below about 0.5 weight percent, of the total fuel to avoid thermal and storage stability problems with the fuel.

What is claimed is:

1. A middle distillate fuel containing at least about 0.5 wt. % of hydrocarbon compounds which contain benzylic alcohol species, benzylic ketone species or mixture thereof wherein said hydrocarbon compounds comprise aromatic compounds, hydroaromatic compounds or mixtures thereof.

2. The fuel of claim 1 containing from about 0.5–75 wt.% of said species.

3. The fuel of claim 1 containing at least about 1 wt. % of said species.

4. The fuel of claim 3 containing from about 2–50 wt. % of said species.

5. The fuel of claim 4 containing from about 5–30 wt. % of said species.

6. The fuel of claim 5 containing at least about 10 wt. % of said species.

7. A middle distillate fuel boiling within the range of from about 160°–400° C. containing at least about 0.5 wt. % hydrocarbon compounds which contain benzylic alcohol species, benzylic ketone species or mixture thereof wherein said hydrocarbon compounds comprise aromatic compounds, hydroaromatic compounds or mixture thereof.

8. The fuel of claim 7 containing between about 0.5–75 wt. % of said species.

9. The fuel of claim 7 containing at least about 1 wt.% of said species.

10. The fuel of claim 9 containing from about 2–50 wt. % of said species.

11. The fuel of claim 10 containing from about 5–30 wt. % of said species.

12. The fuel of claim 7 containing at least about 10 wt. % of said species.

13. A middle distillate fuel boiling within the range of from about 160°–400° C. containing at least about 0.5 wt. % of hydrocarbon compounds which contain benzylic alcohol species, benzylic ketone species or mixture thereof wherein said hydrocarbon compounds are selected from the group consisting of alkyl benzenes, alkylnaphthalenes, 1,2,3,4 tetrahydronaphthalenes, acenaphthenes, indans, fluorenes and mixtures thereof.

14. The fuel of claim 13 containing from about 0.5–75 wt.% of said species.

15. The fuel of claim 13 containing at least about 1 wt. % of said species.

16. The fuel of claim 15 containing from about 2–50 wt. % of said species.

17. The fuel of claim 16 containing from about 5–30 wt. % of said species.

18. The fuel of claim 13 containing at least about 10 wt. % of said species.

19. A middle distillate hydrocarbon fuel boiling within the range of from about 160°–400° C. which is selected from the group consisting of light cat cycle oil, light cat heating oil, coker liquids, kerosene, diesel fuel, or mixture thereof and contains at least about 0.5 wt. % hydrocarbon compounds which contain benzylic alcohol species, benzylic ketone species or mixture thereof wherein said hydrocarbon compounds comprise aromatic compounds, hydroaromatic compounds or mixtures thereof.

20. The fuel of claim 19 containing from about 0.5–75 wt.% of said species.

21. The fuel of claim 19 containing at least about 1 wt. % of said species.

22. The fuel of claim 21 containing from about 2–50 wt. % of said species.

23. The fuel of claim 22 containing from about 5–30 wt. % of said species.

24. The fuel of claim 19 containing at least about 10 wt. % of said species.

* * * * *